United States Patent [19]

Karow, Jr.

[11] Patent Number: 4,894,941

[45] Date of Patent: Jan. 23, 1990

[54] DEVICE FOR RELEASABLY SECURING A FLASHLIGHT OR THE LIKE TO A FIREARM

[76] Inventor: Harold E. Karow, Jr., 1115 E. Manitoba St., Milwaukee, Wis. 53207

[21] Appl. No.: 273,205

[22] Filed: Nov. 18, 1988

[51] Int. Cl.[4] ..... F41G 1/34

[52] U.S. Cl. ..... 42/103; 42/101; 362/110

[58] Field of Search ..... 42/103, 101, 100; 362/110, 113, 114; 33/245–250

[56] References Cited

U.S. PATENT DOCUMENTS

| | | | |
|---|---|---|---|
| 784,227 | 3/1905 | Riblet | 362/114 |
| 1,088,502 | 2/1914 | Williams | 362/114 |
| 1,215,171 | 2/1917 | Lewis | 362/110 |
| 1,218,739 | 2/1915 | Weigel | 362/110 |
| 1,262,270 | 4/1918 | Schmidt et al. | 362/110 |
| 2,128,526 | 8/1938 | Eslick | 362/110 |
| 2,314,061 | 3/1943 | Whaley | 362/110 |
| 3,222,511 | 12/1965 | Breeding | 362/110 |
| 3,245,071 | 4/1966 | Pillsbury | 362/110 X |
| 3,260,008 | 7/1966 | Yeomans | 42/100 |
| 4,328,624 | 5/1982 | Ross | 42/101 X |
| 4,488,369 | 12/1984 | Van Note | 42/103 |
| 4,542,447 | 9/1985 | Quakenbush | 42/103 X |

*Primary Examiner*—Charles T. Jordan
*Assistant Examiner*—Michael J. Carone
*Attorney, Agent, or Firm*—Andrus, Sceales, Starke & Sawall

[57] ABSTRACT

A mounting device for detachably securing a flashlight or the like to the barrel of a firearm. The mounting device includes a first portion for detachably securing the mounting device to the firearm barrel, defined by a pair of spaced sidewalls which flex outwardly during mounting thereof to the firearm barrel by application of a force in a direction substantially perpendicular to the longitudinal axis of the firearm barrel. The mounting device includes a second portion for receiving the barrel of a flashlight or the like, including a passage within which the flashlight barrel is mounted. The passage is provided with resilient means for engaging the outer surface of the flashlight barrel for securely retaining the flashlight barrel thereon, and for accommodating varying flashlight barrel sizes.

10 Claims, 1 Drawing Sheet

FIG. 1
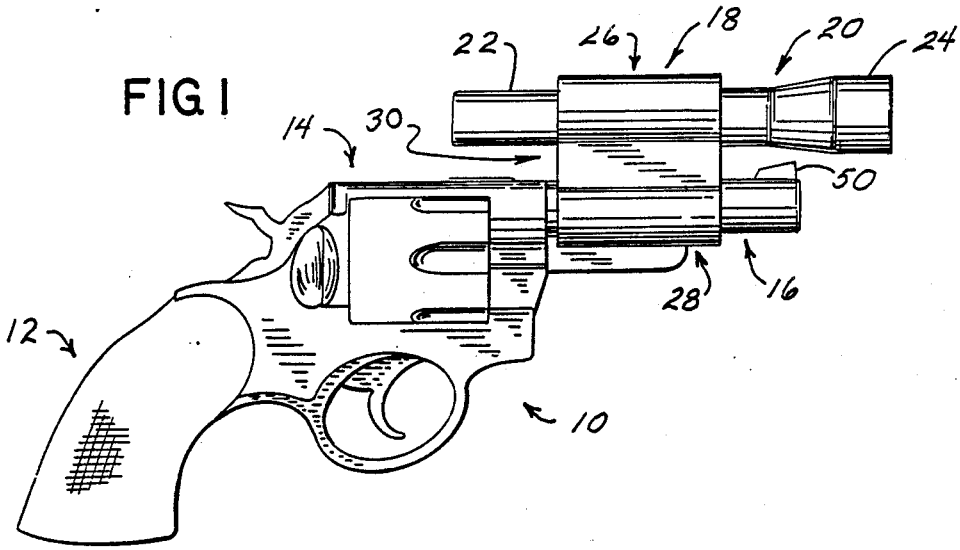
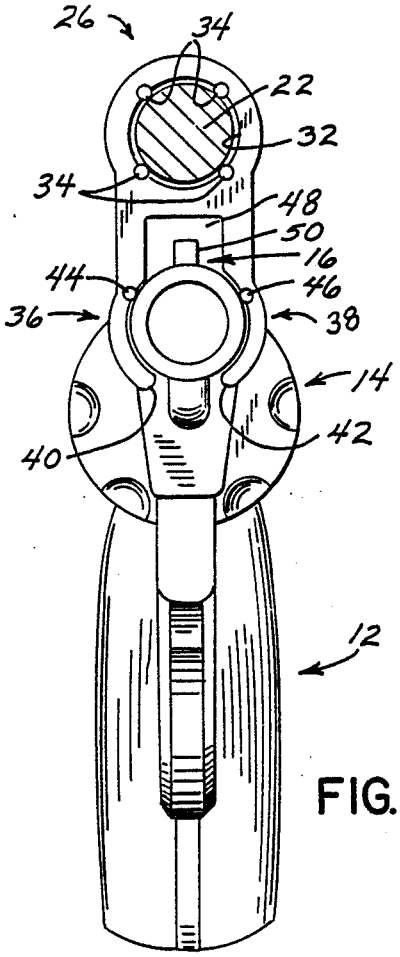
FIG. 2
FIG. 3
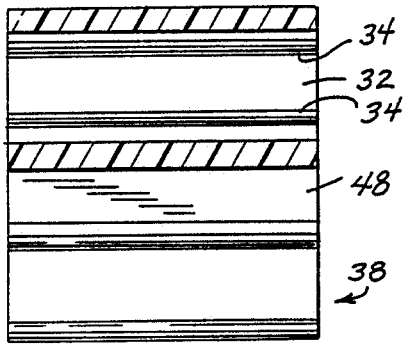
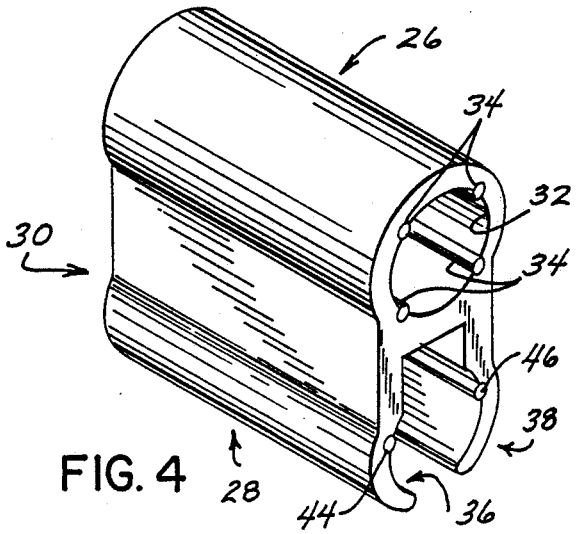
FIG. 4

DEVICE FOR RELEASABLY SECURING A FLASHLIGHT OR THE LIKE TO A FIREARM

BACKGROUND AND SUMMARY OF THE INVENTION

This invention relates to attachments or accessories for firearms, and more particularly to a device for releasably securing a flashlight or the like to a firearm.

A firearm such as a revolver is commonly employed in police work. A recognized problem in this field is that, when using a revolver, it is often necessary to simultaneously use a flashlight or other light producing means when entering a darkened area. While an officer can hold the revolver in one hand and the flashlight in the other in such a situation, this occupies both of the officer's hands. Further, it is often desirable when employing a revolver to use both hands while shooting, and also to have the light-beam trained in the same direction as the barrel of the revolver.

Various ways are known to mount a flashlight or the like to the barrel of a firearm. One structure for accomplishing this purpose is shown in Van Note U.S. Pat. No. 4,488,369. This patent relates to a marksmanship training apparatus in which a light source is mounted to the top of the revolver by means of a nut and threaded stud arrangement. Another such structure is shown in Weigel U.S. Pat. No. 1,128,739 which provides a bracket for engaging a longitudinal rib provided on the top of the revolver barrel. Whaley U.S. Pat. No. 2,314,061 relates to a structure for mounting a flashlight to the underside of the revolver, with the rear wall of the mounting structure engaging the forward end of the revolver body. This construction prevents longitudinal forward and/or rearward movement of the flashlight during firing of the revolver.

A disadvantage to the structures shown in the above-noted patents, as well as in other approaches to providing a structure for mounting a flashlight to a firearm, is that a series of manual manipulations must be undertaken in order to attach or detach the flashlight to or from the firearm.

A further recognized problem in mounting a flashlight or the like to a firearm is the prevention of forward and rearward movement of the flashlight during firing of the firearm, and retaining the flashlight in position during handling of the firearm throughout a range of positions other than horizontal. One solution to this problem is to mechanically connect the firearm to the mounting structure. Another approach is as showon in Whaley U.S. Pat. No. 2,314,061, which discloses engagement of the mounting structure with the forward end of the revolver body, and mounting the flashlight such that its butt end is retained therein.

The present invention is designed to eliminate or alleviate the above-noted problems. In accordance with the invention, a device for releasably securing a flashight or the like to a firearm includes an upper portion and a lower portion. The device is preferably an integrally formed molded member constructed of a resilient material. The lower portion is adapted for detachable engagement to the barrel of a firearm, such as revolver, and preferably includes a pair of sidewalls. The sidewalls are formed such that the space therebetween is less than the transverse dimension of the revolver barrel, so that sidewalls flex outwardly during mounting to the revolver barrel and return to amounting position in which the sidewalls exert a clamping force on the barrel for retaining the flashlight mounting device thereon. The device is preferably mountable to the revolver barrel by means of a push-on motion in a direction substantially transverse to the longitudinal axis of the revolver barrel. The resilient nature of the maaterial from which the device is formed allows such outward flexing of the sidewalls during mounting, and exertion of the clamping force on the revolver barrel thereafter. The upper portion of the device is adapted to releasably secure a flashlight or the like thereto, and to retain the flashlight in position during periods of handling of the revolver and during firing. The upper portion preferably includes a longitudinally formed passage having a transverse dimension slightly larger than the external transvere dimension of the flashlight barrel.

Flashlights suitable for use with the mounting device of the invention are manufactured by a number of manufacturers, and the barrels of the flashlights sold by the various manufacturers have differing transverse dimensions. The longitudinal passage formed in the upper portion of the mounting device of the invention is provided with means for engaging and retaining a flashlight having a barrel of a diameter within a certain range, allowing use of the mounting device of the invention in combination with a flashlight as manufactured by many of the various manufacturers. This feature of the invention also securely engages and retains the flashlight barrel within the longitudinal passage, preventing longitudinal forward and rearward movement of the flashlight. In accordance with this aspect of the invention, the longitudinal passage formed in the upper portion of the mounting device of the invention is provided with resilient retaining means. The resilient retaining means is capable of accommodating flashlights of varying diameters within the longitudinal passage, and securely engaging the flashlight barrel for preventing longitudinal movement thereof. In one embodiment, the resilient means comprises a series of resilient ribs projecting into the longitudinal passage and spaced radially about the circumference of the inner wall defining the longitudinal passage. In one embodiment, the resilient ribs extend throughout substantially the entire length of the longitudinal passage.

The inwardly facing sidewalls of the lower portion of the mounting device may also be provided with resilient means for securely engaging the revolver barrel and preventing longitudinal movement of the mounting device thereon during firing. In one embodiment, such resilient means comprises one or more resilient ribs as defined above provided on each inwardly facing sidewall.

BRIEF DESCRIPTION OF THE DRAWINGS

The drawings illustrate the best mode presently contemplated of carryingn out the invention.

In the drawings:

FIG. 1 is a side elevaation view of a revolver to which a flashlight has been releasably secured by the mounting device of the invention;

FIG. 2 is a front end elevation view of the revolver, flashlight and mounting device as showon in FIG. 1;

FIG. 3 is a sectional view of the mounting device of the invention, taken along the longitudinal axis thereof; and FIG. 4 is an isometric view of the mounting device of the invention.

DETAILED DESCRIPTION OF THE PREFERRED EMBODIMENT

As shown in FIG. 1, a revolver 10 includes a handle 12, a body portion 14 and a baarrel 16. A mounting device 18 is provided for releasably securing a flashlight 20 to revolver baarrel 16. As is known, flashlight 20 includes a barrel portion 22 in which batteries are housed, and a head portion 24 containing a lamp. Mounting device 18 includes an upper portion 26 which receives flashlight barrel 22, a lower portion 28 which receives revolver barrel 14, and a central portion 30 disposed therebetween.

Mounting device 18 is preferably formed of a resilient plastic material marketed under the designation "Celecon".

With reference to FIGS. 2, 3 and 4,upper portion 26 is substantially cylindrical in shape, and includes a longitudinally extending inner passage defined by an inner wall 32. The transverse dimension of the passage so defined is larger than the transverse dimension of flashlight barrel 22. As noted, flashlight barrel 22 may vary in diameter according to the manufacturer of flashlight 20, and the diameter of the passage defined by inner wall 32 is large enough to accommodate the largest diameter of flashlight barrel 22 of the type of flashlight shown.

Inner wall 32 of upper portion 26 is provided with a series of longitudinally extending grooves radially spaced at regular intervals about its circumference. Such grooves receive a series of resilient ribs 34, and are formed such that a portion of the cross-section of rib 34 projects into the passage defined by inner wall 32. As showon, ribs 34 are circular in cross-section, with the majority of the cross-section of ribs 34 disposed within the grooves provided in inner wall 32. Ribs 34 are constructed of a resilient rubber material, and extend throughout substantially the entire length of the passage defined by inner wall 32.

With the construction shown, ribs 32 act to retain flashlight barrel 22 securely within the passage defined by inner wall 32. The rsilient nature of ribs 34 accommodates flashlights having a barrel 22 of varying diameters, while securely retaining such within the passage defined by inner wall 32.

Lower portion 28 of mounting device 18 includes a pair of spaced sidewalls 36, 38. As shown, sidewalls 36, 38 are arcuate in cross-section, terminating in lower surfaces 40, 42, respectively. The inner surfaces of sidewalls 36, 38 define a passage therebetween which preferably has a transverse dimension somewhat less than the transverse dimension of revolver barrel 16 to which mounting device 18 is mounted. The space between lower surfaces 40, 42 of sidewalls 36, 38 is substantially less than the greatest transvere dimension of gun barrel 16.

With the descirbed construction, lower portion 28 of mounting device 18 is adapted to be mounted to revolver barrel 16 by application of a downward force in a direction substantially perpendicular to the longitudinal axis of revolver barrel 16. Lower surfaces 40, 42 are placed onto the upper outer surfaces of revolver barrel 16, and such a force is then applied to mounting device 18 so as to cause lower sidealls 36, 38 to flex outwardly and to thereafter resume the mounting position as shown in FIG. 2, wherein the outer surfaces of revolver barrel 16 are clamped between the inner surfaces of sidewalls 36, 38. In this manner, mounting device 18 is securely retained on revolver barrel 16.

The inner surfaces of lower sidewalls 36, 38 are preferably provided with a longitudinally extending groove, which grooves are adapted to receive a pair of resilient ribs 44, 46, respectively. As with ribs 34 provided in upper portion 26 of mounting device 18, ribs 44, 46 are constructed of a resilient material such as rubber and grip the outer surfaces of revolver barrel 16 so as to prevent longitudinal or rotational movement of mounting device 18 after mounting thereof to revolver barrel 16.

The central portion 30 of mounting device 18 is constructed so as to provide an inner passage 48. Inner passage 48 provides clearance for allowing the user of revolver 10 to sight through central portion 30 and to employ a sight 50 mounted to the end of revolver barrel 16.

The provision of resilient ribs 44, 46 on the inner surfaces of lower sidewalls 36, 38 allows mounting device 18 to be used with revolvers having barrels of varying diameters, while providing secure mounting of mounting device 18 thereto.

It has been found that the outward flelxing of lower sidealls 36, 38 when mounted on revolver barrel 16 provides deformation of the passage in upper porion 26 defined by upper wall 32 so as to increase the gripping force provided by ribs 34 on flashlight barrel 22. This action reinforces the secure mounting of flashlight 20 to mounting device 18.

It is to be appreciated that longitudinal ribs 34, 44 and 46 may be situated in a variety of orientations. For example, ribs 34 may be replaced by one or more substantially circular rings which are mounted within a circumferential groove provided in inner wall 32. The same is true for ribs 44, 46 mounted in the lower surface of lower sidewalls 36, 38, in that one or more such ribs could be provided normal to the axis of ribs 44, 46 as shown.

Various alternatives and modifications are contemplated as being within the scope of the following claims particularly pointing out and distinctly claiming the subject matter regarded as the invention.

I claim:

1. A mounting device for detachably securing a flashlight or the like to the barrel of a firearm, comprising:

firearm barrel engaging means for detachably securing said mounting device to said firearm barrel, and including a first passage adapted to receive said firearm barrel;

resilient means provided ons aid mounting device and projecting into said first passage for engaging the outer surface of said firearm baarrel for preventing longitudinal or rotational movement of said mounting device on said firearm barrel; and means for securing a flashlight or the like to said firearm barrel engaging means, comprising a second passage adapted to receive the barrel of said flashlight or the like.

2. The mounting device of claim 1, further comprising resilient means associated with and projecting into said second passage for engaging the outer surface of said flashlight or the light for securely retaining said flashlight or the like therewithin.

3. A mounting device for detachably securing a flashlight or the like to a firearm having a barrel, comprising:

a first portion adapted for detachable mounting to said firearm barrel by application of a push-on force in a direction substantially transverse to the axis of said firearm barrel, wherein said first portion includes a passage adapted to receive said firearm barrel;

resilient means provided on said first portion and projecting into said passage for engaging the outer surface of said firearm barrel after mounting thereto for preventing longitudinal or rotational movement of said mounting device on said barrel; and a second portion including a longitudinally extending passage adapted to receive said flashlight or the like.

4. The mounting device of claim 3, wherein said first portion includes a pair of spaced sidewalls having inner surfaces defining said passage, said sidewaall inner surfaces being adapted to engage the outer surface of said firearm barrel for detachably securing said mounting device thereto, and wherein said resilient means asociated with said passage comprises a resilient rib provided on the inner surfce of each sidewall for engaging the outer surface of said firearm barrel.

5. The mounting device of claim 4, wherein said resilient rib extends longitudinally throughout substantially the entire length of said sidewall inner surface.

6. The mounting device of claim 3, wherein the longitudinally extending passage in said second portion is provided with resilient means for engaging and securing said flashlight to said mounting device, said resilient means comprising two or more spaced resilient ribs, with a portion of each rib extending into said passage for engaging the outer surface of said flashlight for securing said flashlight thereto.

7. The mounting device of claim 6, wherein said two or more resilient ribs are disposed within two or more grooves formed in the inner wall defining said passage.

8. The mounting device of claim 7, wherein said resilient ribs, and said grooves within which said ribs are mounted, extend longitudinally throughout substantially the entire length of said passage.

9. A mounting device for detachably securing a flashlight or the like to a firearm having a barrel, comprising:

a first portion adapted for detachably mounting to said firearm barrel by application of a push-on force in a direction substantially transverse to the axis of said firearm barrel, said first portion being defined by a pair of spaced sidewalls having inner surfaces shaped correspondingly to the outer surface of said firearm barrel, said spaced sidewalls being adapted to flex outwardly during mounting of said firs portion to said firearm barrel and to thereafter return at least partially to their original position for clamping said firearm barrel therebetween and retaining said mounting device thereon, said first portion being constructed of a resilient plastic material so as to allow said outward flexing of said spaced sidewalls;

resilient means projecting inwardly from said sidewallsl for engaging said barrel and securing said mounting device thereto; and a second portion including a longitudinally extending passage adapted to receive said flashlight or the like.

10. A mounting device for detachably securing a flashlight or the like to the barrel of a firearm, comprising:

firearm barrel engaging means for detachably securing said mounting device to said firearm barrel, and comprising a pair of spaced sidewalls having inner surfaces shaped correspondingly to said firearm barrel, said sidewalls being adapted to flex outwardly during mounting to said firearm barrel and thereafter return at least partially to their original position for clamping said firearm barrel therebetween, said sidewalls being constructed of a resilient plastic material for accommodating the outward flexing of said sidewalls;

resilient means projecting inwardly from said sidwalls for engaging said firearm barrel and securing said mounting device thereto; and means for securing a flashlight or the light to said firearm barrel engaging means, comprising a passage adapted to receive said flashlight or the like therewithin.

* * * * *

UNITED STATES PATENT AND TRADEMARK OFFICE

CERTIFICATE OF CORRECTION

PATENT NO. : 4,894,941

DATED : January 23, 1990

INVENTOR(S) : HAROLD E. KAROW, JR.

It is certified that error appears in the above-identified patent and that said Letters Patent is hereby corrected as shown below:

Claim 1, col. 4, line 51, delete "ons aid" and substitute therefor ---on said ---;

Claim 1, col. 4, line 53, delete "baarrel" and substitute therefor --- barrel ---;

Claim 2, col. 4, line 63, delete "light" and substitute therefor --- like ---;

Claim 4, col. 5, line 16, delete "sidewaall" and substitute therefor --- sidewall ---;

Claim 4, col. 5, lines 19 and 20, delete "asociated" and substitute therefor --- associated ---;

Claim 4, col. 5, line 21, delete "surfce" and substitute therefor --- surface ---;

Claim 9, col. 6, line 1, delete "detachably" and substitute therefor --- detachable ---

Claim 9, col. 6, line 9, delete "firs" and substitute therefor --- first ---;

UNITED STATES PATENT AND TRADEMARK OFFICE

CERTIFICATE OF CORRECTION

PATENT NO. : 4,894,941

DATED : January 23, 1990

INVENTOR(S) : HAROLD E. KAROW, JR.

It is certified that error appears in the above-identified patent and that said Letters Patent is hereby corrected as shown below:

Claim 9, col. 6, lines 16 and 17, delete "sidewallsl" and substitute therefor --- sidewalls ---.

Signed and Sealed this

Twenty-fifth Day of June, 1991

*Attest:*

HARRY F. MANBECK, JR.

*Attesting Officer*

*Commissioner of Patents and Trademarks*